US007393293B2

(12) United States Patent
Guerzini et al.

(10) Patent No.: US 7,393,293 B2
(45) Date of Patent: Jul. 1, 2008

(54) BASKETBALL SYSTEM WITH ADJUSTABLE GOAL HEIGHT HAVING MECHANICAL ADVANTAGE

(75) Inventors: Mike Guerzini, Newburgh, IN (US); James R. Allshouse, Newburgh, IN (US)

(73) Assignee: SOP Services, Inc., Las Vegas, NV (US)

( * ) Notice: Subject to any disclaimer, the term of this patent is extended or adjusted under 35 U.S.C. 154(b) by 377 days.

(21) Appl. No.: 11/087,261

(22) Filed: Mar. 23, 2005

(65) Prior Publication Data

US 2005/0215357 A1 Sep. 29, 2005

Related U.S. Application Data

(60) Provisional application No. 60/557,040, filed on Mar. 26, 2004.

(51) Int. Cl.
*A63B 63/08* (2006.01)

(52) U.S. Cl. ..... 473/484; 473/483

(58) Field of Classification Search ..... 473/483, 473/485, 481–482, 484

See application file for complete search history.

(56) References Cited

U.S. PATENT DOCUMENTS

| | | | | |
|---|---|---|---|---|
| 1,924,811 | A * | 8/1933 | Schulz | 473/481 |
| 2,699,964 | A * | 1/1955 | Hartung | 293/115 |
| 5,879,247 | A | 3/1999 | Winter et al. | |
| 6,135,901 | A * | 10/2000 | van Nimwegen | 473/484 |
| 6,419,598 | B1 * | 7/2002 | Winter et al. | 473/484 |

* cited by examiner

*Primary Examiner*—Gene Kim
*Assistant Examiner*—M Chambers
(74) *Attorney, Agent, or Firm*—Woodard, Emhardt, Moriarty, McNett & Henry LLP

(57) ABSTRACT

Certain preferred embodiments of the present invention provide an improved adjustment system and method for raising and lowering a basketball backboard and goal using a telescoping assembly such as an extension and retraction cylinder. In some preferred embodiments, an actuator assembly is mounted to a midpoint of a lever arm and situated such that the extension or retraction of the actuator assembly causes a mechanically advantaged travel in the height adjustment structure for the goal assembly. As a preferred feature, the present invention provides a greater height adjustment distance in the backboard assembly for a reduced number of cranks compared to a direct connection between an actuator incorporated in or directly attached to an adjustment arm.

29 Claims, 11 Drawing Sheets

BASKETBALL SYSTEM WITH ADJUSTABLE GOAL HEIGHT HAVING MECHANICAL ADVANTAGE

The present application claims priority to provisional application Ser. No. 60/557,040, filed Mar. 26, 2004, incorporated herein by reference.

FIELD OF THE INVENTION

The present system relates to adjustable basketball goals, and in particular to a system and method for efficiently raising and lowering a basketball backboard and hoop in relation to a support pole.

BACKGROUND OF THE INVENTION

Various methods of raising and lowering basketball goals as desired by a user are known. It is well known in certain applications to use an actuator or compression assembly with a crank mechanism, allowing the user to turn the crank to raise and lower the basketball scoring height. Most such systems use a direct relationship between the assembly extension and the height adjustment, causing a user to turn an adjustment crank many times to achieve a desired goal height. An improved system and method for causing a backboard to raise or lower in a ratio to the number of turns of the crank on the system is desired.

SUMMARY OF THE INVENTION

Certain preferred embodiments of the present invention provide an improved adjustment system and method for raising and lowering a basketball backboard and goal using a telescoping assembly such as an extension and retraction cylinder. In some preferred embodiments, an actuator assembly is mounted to a midpoint of a lever arm and situated such that the extension or retraction of the actuator assembly causes a mechanically advantaged travel in the height adjustment structure for the goal assembly. As a preferred feature, the present invention provides a greater height adjustment distance in the backboard assembly for a reduced number of cranks compared to a direct connection between an actuator incorporated in or directly attached to an adjustment arm.

In a preferred embodiment of the present invention, a basketball goal is comprised of a vertical support element and a backboard assembly. The basketball goal is further comprised of an adjustment structure which adjustably mounts the backboard assembly to the support element and has a rear extension portion which is movable to control the height of the backboard assembly. The basketball goal further includes at least one adjustment arm that extends downward from the rear extension portion and at least one lever arm that has a proximal end which is pivotally mounted adjacent to the support element and has a distal end that is pivotally mounted to the adjustment arm. Additionally, an actuator is mounted to the lever arm at a midpoint between the proximal end and the distal end, wherein operation of the actuator causes the lever arm to rotate and correspondingly adjust the height of the backboard assembly.

In another preferred embodiment of the present invention, a basketball goal is comprised of a vertical support element and a backboard assembly which is adjustably mounted to the vertical support element. In addition, the basketball goal includes at least one lever arm which has a proximal end that is secured adjacent to the support element and has a distal end that is linked to the backboard assembly. An actuator is mounted to the lever arm at a midpoint between the proximal end and the distal end, wherein operation of the actuator causes the distal end of the lever arm to raise or lower and to correspondingly adjust the height of the linked backboard assembly.

In yet another preferred embodiment of the present invention, a basketball goal consists of a vertical support element and a backboard assembly that is adjustably mounted to the vertical support element. A lever arm is used to control adjustment of the backboard assembly and defines a first lever arm length. Moreover, an actuator operably connects to the lever arm and controls the lever arm over a second lever arm length, wherein the second lever arm length is less than the first lever arm length.

Objects and advantages of certain embodiments of the present invention will be apparent from the description and figures.

DESCRIPTION OF PREFERRED EMBODIMENTS

Figure 1:
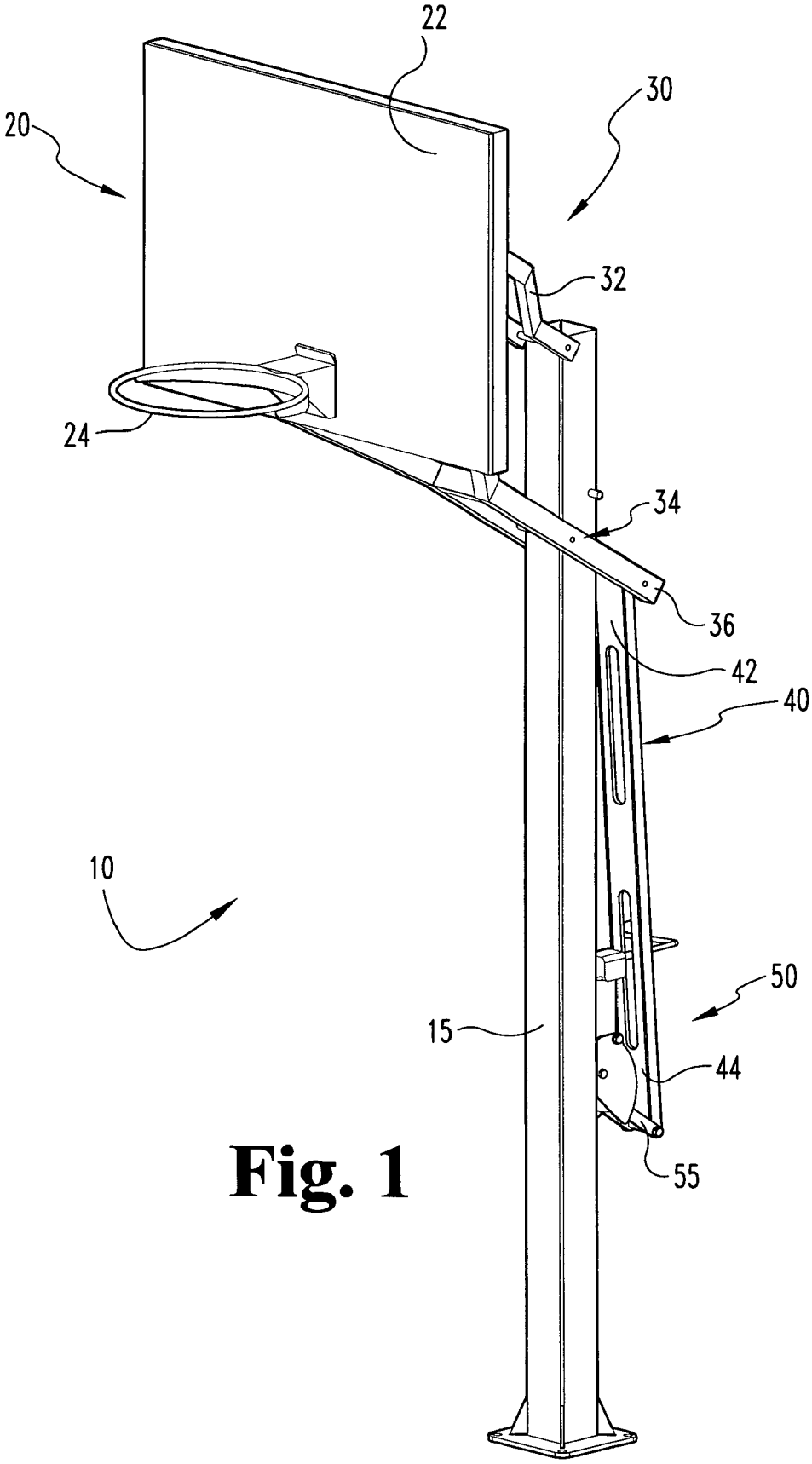
FIG. 1 is a perspective view of a preferred embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein are contemplated as would normally occur to one skilled in the art to which the invention relates.

Certain preferred embodiments of the present invention provide an improved adjustment system and method for raising and lowering a basketball backboard and goal using a telescoping assembly such as an extension and retraction cylinder. In some preferred embodiments, an actuator assembly is mounted to a midpoint of a lever arm and situated such that the extension or retraction of the actuator assembly causes a mechanically advantaged travel in the height adjustment structure for the goal assembly. As a preferred feature, the present invention provides a greater height adjustment distance in the backboard assembly for a reduced number of cranks compared to a direct connection between an actuator incorporated in or directly attached to an adjustment arm.

Illustrated in FIG. 1 is a conventional basketball goal 10 incorporating an adjustment assembly or mechanism 50 according to the present invention. The entire goal may be fixed or portable. Goal system 10 includes a conventional vertical support element such as a round or square pole 15, and a backboard assembly 20 including a backboard 22 and a hoop 24 in front of the pole. Backboard assembly 20 is adjustably mounted to pole 15 using a parallelogram structure 30. Parallelogram structure 30 includes at least one upper arm 32, preferably two, and at least one lower arm 34, preferably two, extending between pole 15 and backboard assembly 20. As backboard assembly 20 rises and lowers in relation to pole 15, it is supported by the parallelogram assembly 30 which is deformable, but which retains a parallelogram shape. In a preferred embodiment, one or two of the upper arms or lower arms includes a rear extension portion illustrated as rear extension 36 of lower arms 34 in FIG. 1, which can be used to control rotation of the parallelogram structure 30.

Rear extension portion or portions 36 is/are connected to one or two parallel adjustment arms 40 pivotally connected at an upper end 42 to the rear extension portion and extending downward. Adjustment arm or arms 40 are secured at the lower/opposing end 44 to adjustment mechanism assembly 50, illustrated as including a corresponding one or pair of lever arms 55. Adjustment arm 40 is illustrated as two elongate portions joined in upper, middle and lower locations in FIGS. 1-2, and is shown in a related option of two separate and parallel elongate portions in FIGS. 3, 4 and 5.

In an optional feature, the mass and weight of the backboard assembly and support structure can be arranged to be all or partially balanced between the front and rear of the pole. Examples of this include incorporating weight or heavier materials in the rear extension portions or adjustment arms to balance the mass of the backboard and forward arm portions. The weight can be an added external or internal mass such as a metal piece, sand or concrete or can be an integral piece such as a solid bar portion. Alternate balance assisting mechanisms include springs or shock absorbers. The balanced mass assists users by only requiring a reduced or minimal force to be applied to the adjustment arms in order to raise and lower the backboard assembly height and avoids the user directly attempting to lift or move the entire weight of the backboard mass.

Figure 2:
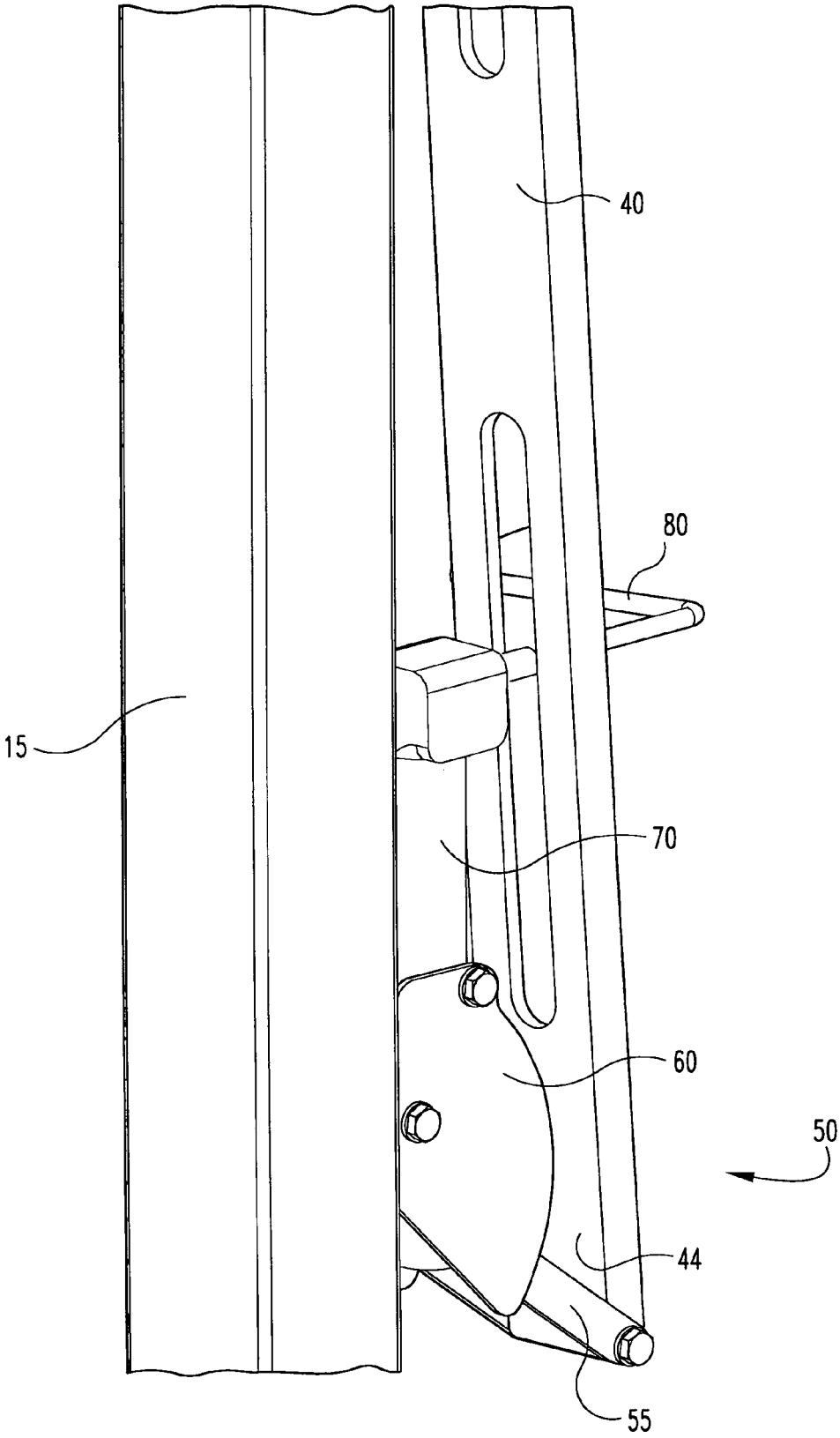
FIG. 2 is a close-up view of the adjustment mechanism used in the embodiment of FIG. 1.
Figure 3:
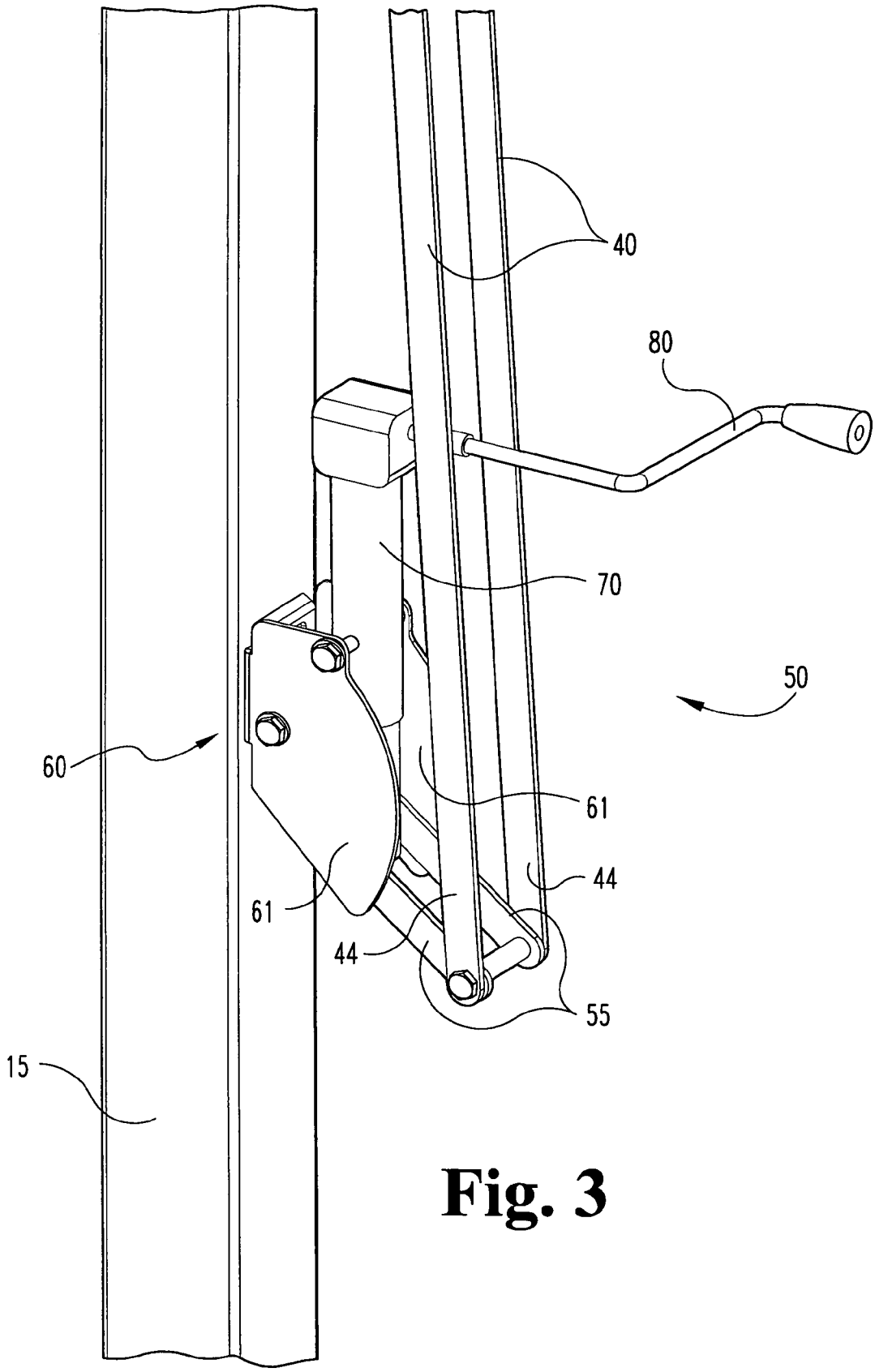
FIG. 3 is a side view of the adjustment mechanism of FIG. 2.

FIGS. 2 and 3 illustrate up close views of adjustment assembly 50 mounted between pole 15 and adjustment arms 40. Preferably the lower end of each adjustment arm is attached to a corresponding lever arm 55 pivotally mounted between pole 15 and adjustment arms 40. In the preferred embodiment shown, adjustment assembly 50 includes optional side bracket plates 60. An actuator assembly 70, for example an extension cylinder, is driven by handle or crank 80. Adjustment assembly 50 is preferably mounted to pole 15 on the rear of the pole in relation to backboard assembly 20, and preferably at a height where crank 80 is easily accessible to users. Crank 80 may be detachable or the adjustment assembly 50 may be lockable in a fixed position as a safety feature.

Figure 4:
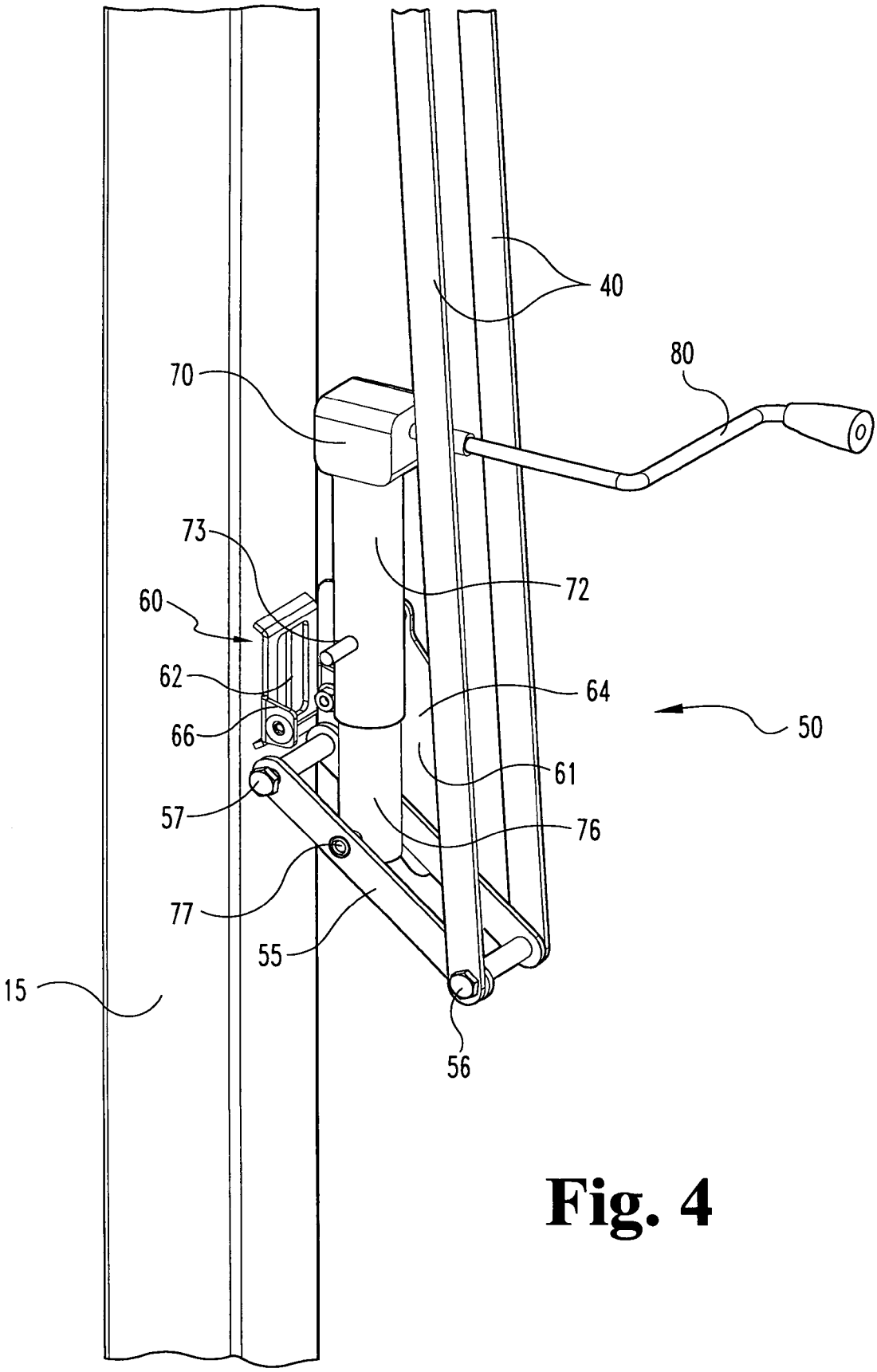
FIG. 4 is a perspective rear view of the adjustment mechanism of FIGS. 2 and 3 with certain portions removed for clarity.

FIG. 4 illustrates a detailed view of adjustment assembly 50 with one side bracket plate 60 removed for clarity. Lever arm 55 extends from pole 15 to arm 40 and includes a distal end 56 pivotally mounted to a lower end of arm 40, and includes a proximal end 57 pivotally mounted on or closely adjacent pole 15. A bracket assembly 60 secures adjustment assembly 50 to pole 15. In one version of a bracket assembly, bracket sleeve 66 is attached at an upper and lower portion to pole 15, creating a sleeve or slide-through space between bracket 66 and pole 15. Bracket plates 61 each include an ear portion 62 and a side plate 64, and can be mounted to pole 15 by sliding ear portion 62 behind bracket sleeve 66. The distance the ear portions 62 slide behind sleeve 66 determines the separation distance of side plates 64. Bracket plates 61 can optionally be secured in place to the pole and in relation to each other by one, two or more bolts or similar fasteners extending all or partly through one or both plates to hold them at a maximum separation. Optionally, fasteners can be secured to one or two tabs of bracket sleeve 66.

In this embodiment, lever arms 55 and actuator assembly 70 are secured to the side plates 64 of the bracket assembly 60. Specifically, proximal ends 57 are pivotably mounted on a bolt with exterior ends outside the side plates 64. The bolt defines the side plates' maximum separation. A cylindrical sleeve may hold the lever arms apart and against the side plates. Distal ends 56 are pivotably secured with bolt and nut fasteners to openings in adjustment arms 40.

Alternately a bracket assembly or adjustment assembly can be mounted or secured to pole 15 using other fastening methods. Examples include bolts, screws, rivets, welding, clamps or other bracket arrangements.

Actuator assembly 70 is functionally mounted between an upper connection point in fixed correspondence to pole 15 and lever arm 55. Actuator assembly 70 includes an upper cylinder portion 72 preferably with a connection point or axis 73 secured to corresponding fixed points, for example in side plates 64. Actuator assembly 70 further includes lower cylinder portion 76 operably connected with upper cylinder portion 72, and pivotally secured at a lower connection point or axis 77 at a midpoint along lever arm 55. Preferably connection points 73 and 77 are aligned with the longitudinal central axis of each corresponding cylinder portion and the actuator assembly. Two lever arms 55, two adjustment arms 40 and corresponding connection points 73 and 77 are shown in parallel as a preferred embodiment; it will be understood that only one of each is required.

Figure 5:
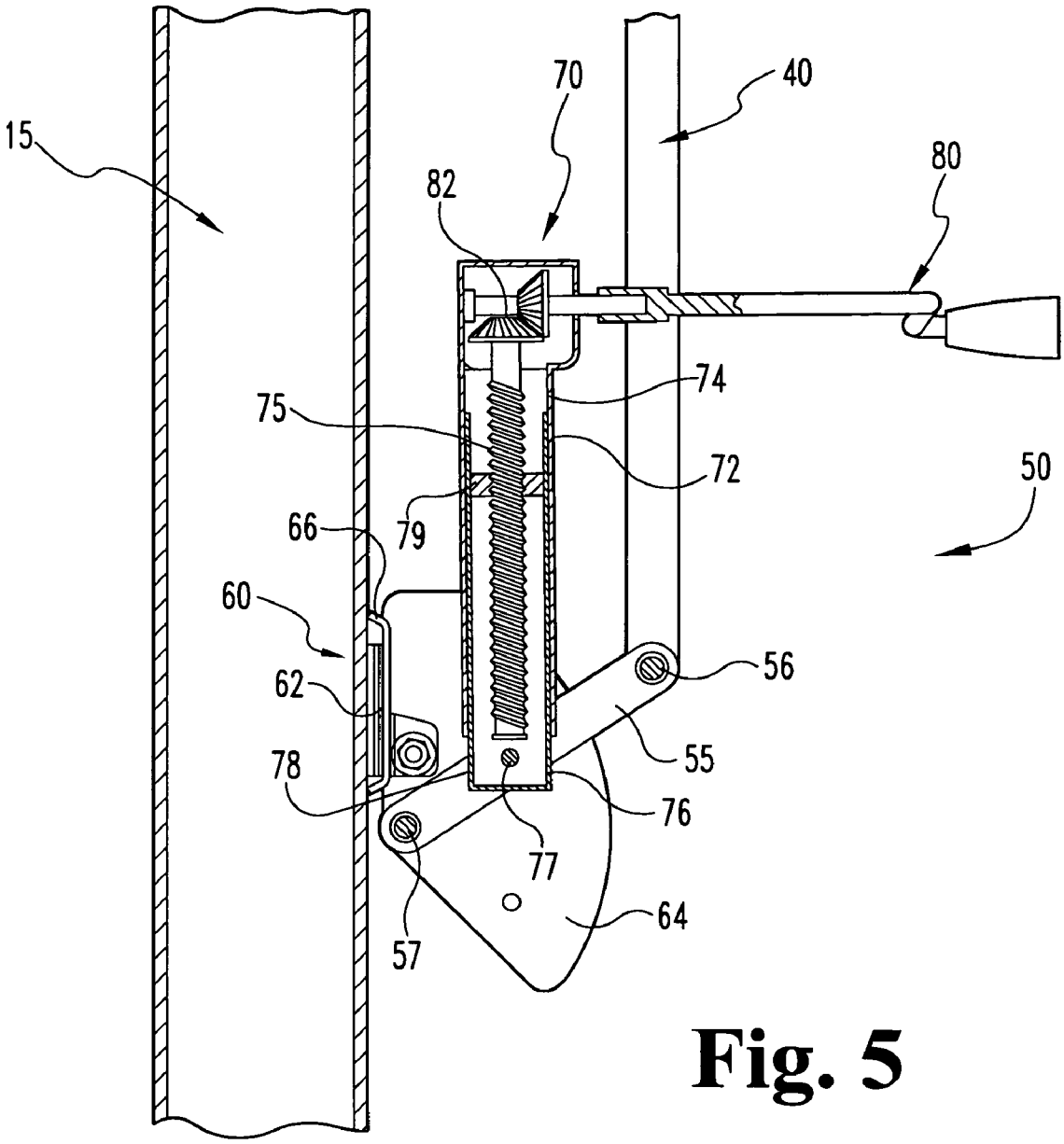
FIG. 5 is a side, cross-sectional view of the adjustment mechanism of FIG. 2.

A cross-sectional view of adjustment assembly 50 on pole 15 is shown in FIG. 5. Actuator assembly 70 includes an upper cylinder portion 72 operably connected to lower cylinder portion 76. Preferably lower cylinder portion 76 can be raised and lowered in relation to upper cylinder portion 72, for example by telescoping, which in turn causes a rotation of lever arm 55 around proximal end 57 to raise and lower distal end 56 and correspondingly adjustment arms 40. In a preferred embodiment, upper cylinder portion 72 includes an outer shell 74 and an inner worm gear or screw 75. Lower cylinder portion 76 includes an inner shell 78, preferably sized to be received and telescope within upper shell 74, and further includes bearing point 79 such as a threaded bearing nut or plate. Bearing point 79 is preferably threadably engaged with worm gear 75. As illustrated, crank 80 engages the shaft of worm gear 75 via a set of bevel gears 82. It will be understood that the worm gear and bearing point and/or the telescoping direction and/or the inner/outer relationship of upper cylinder portion and lower cylinder portion can be reversed without functionally effecting the present invention.

Figure 6:
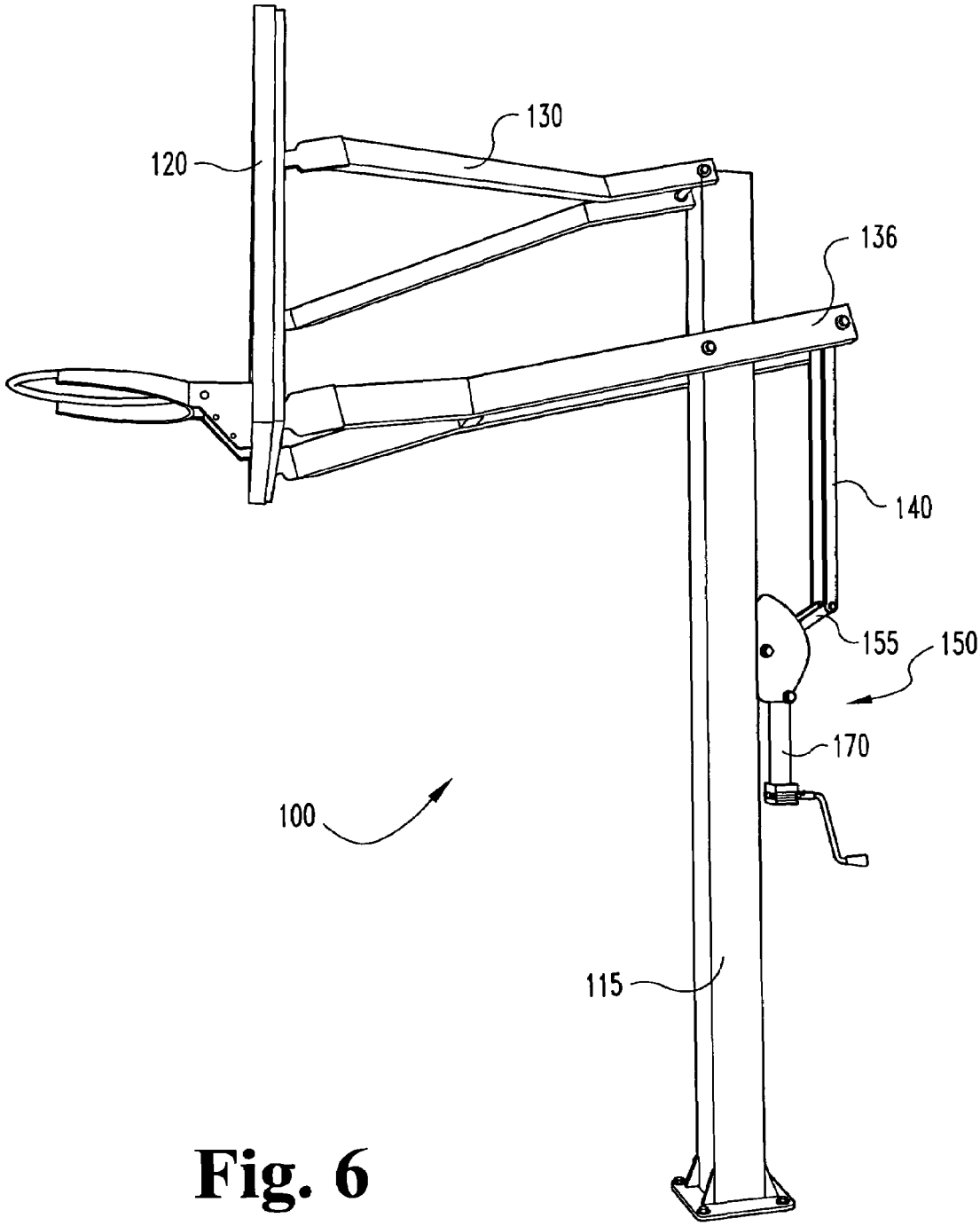
FIG. 6 is a side view of an alternate preferred embodiment of the present invention.

Illustrated in FIG. 6 is an alternate version of a basketball goal 100 incorporating an adjustment assembly or mechanism 150. Goal system 100 includes a vertical support element such as a pole 115, and a conventional backboard assembly 120 including a backboard and a hoop. Backboard assembly 120 is adjustably mounted to pole 115 using a linkage structure 130. Linkage structure 130 includes one or two upper arms and one or two lower arms extending between pole 115 and backboard assembly 120. In certain preferred embodiments, linkage structure 130 includes at least one rear extension portion 136 which can be used to control the linkage structure and backboard assembly 120.

Linkage structure 130 further includes an adjustment portion 140, for example one or two adjustment arms, connected at an upper end to the rear extension portion and extending downward. Adjustment portion 140 is secured at the lower/opposing end to adjustment mechanism assembly 150, illustrated as including a pair of lever arms 155.

Figure 7:
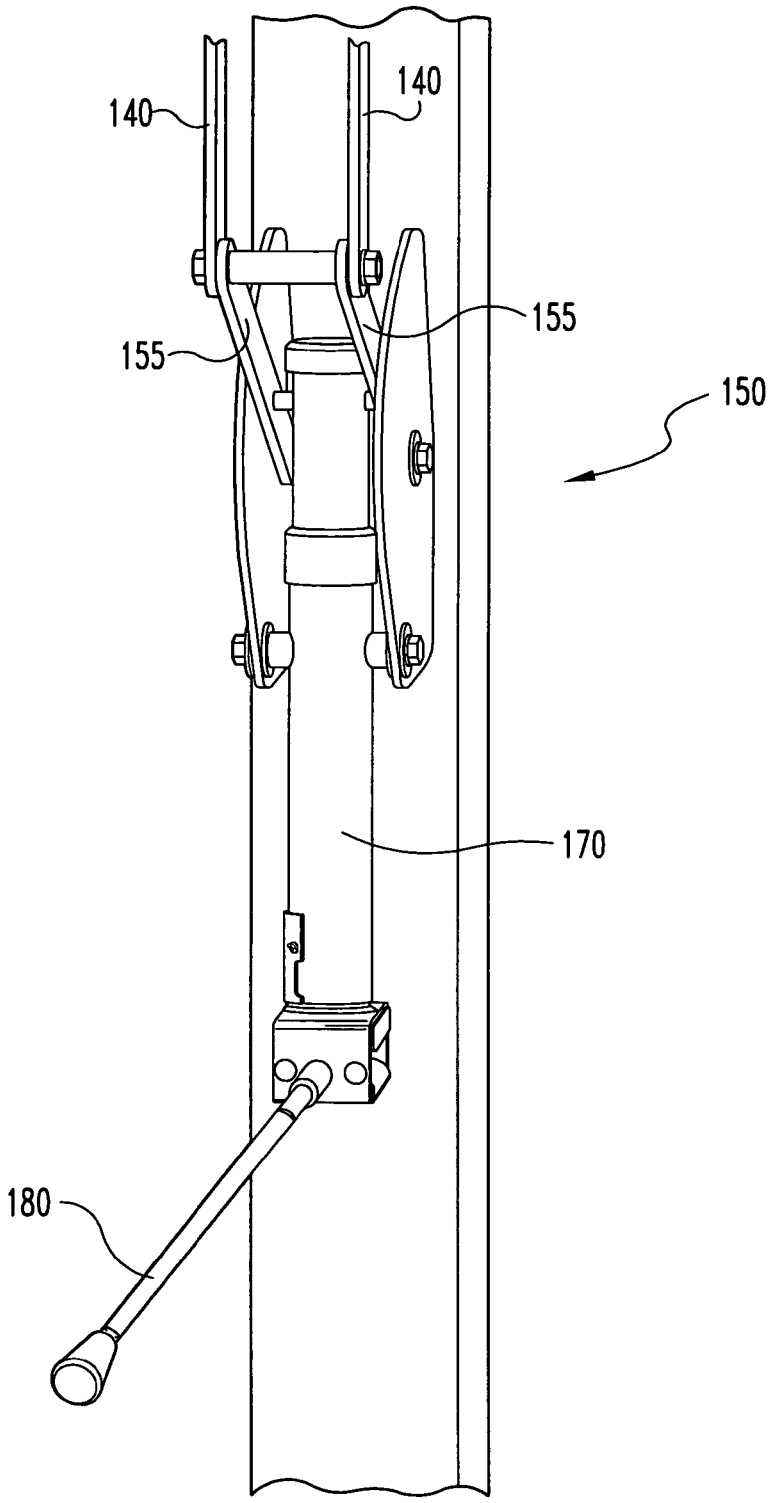
FIG. 7 is a close-up rear view of the adjustment assembly of FIG. 6.
Figure 8:
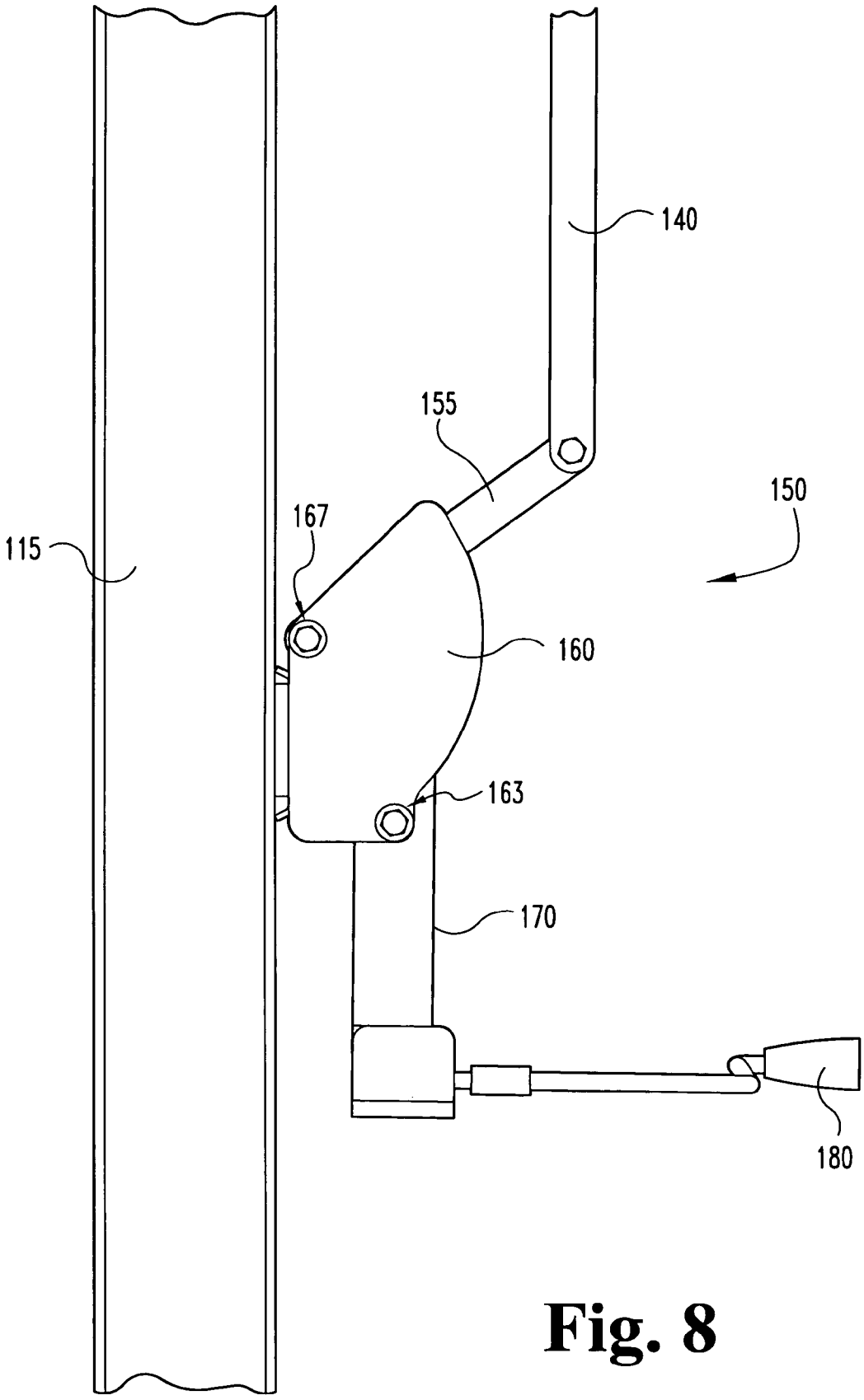
FIG. 8 is a close-up side view of the adjustment assembly of FIG. 6.

Preferably the linkage structure 130 is attached to lever arms 155 which communicate between pole 115 and the linkage structure. FIGS. 7 and 8 illustrate up close views of adjustment assembly 150 operating between pole 115 and adjustment portion 140. In the preferred embodiment shown, adjustment assembly 150 includes optional bracket plates 161, and an actuator 170 driven, for example, by a rotatable handle 180. Adjustment assembly 150 is preferably mounted to pole 115 on the rear of the pole in relation to backboard assembly 120, and preferably at a height where handle 180 is easily accessible to users.

Figure 9:
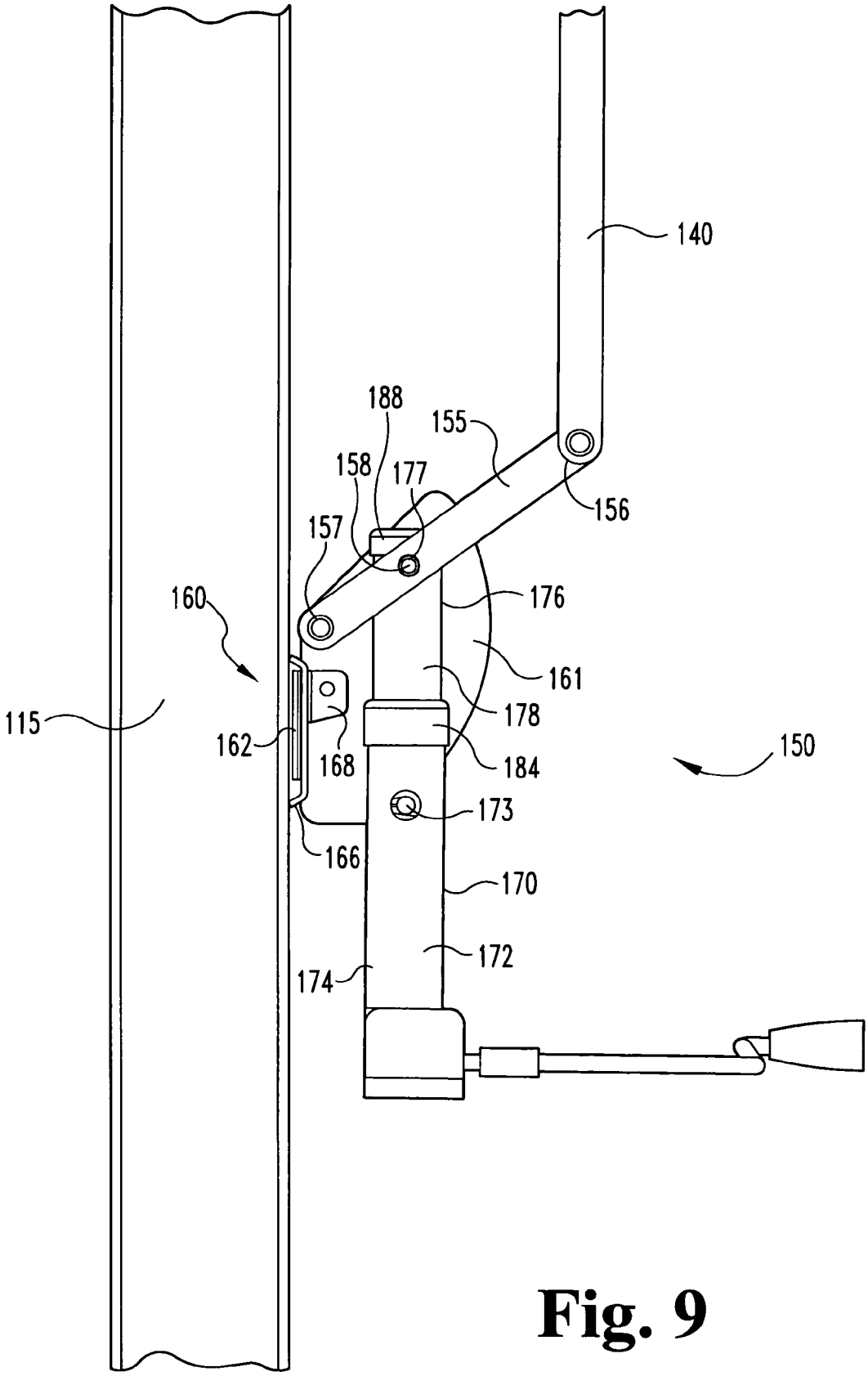
FIG. 9 is a side view of the adjustment assembly of FIGS. 7 and 8 with portions removed for clarity.

FIG. 9 illustrates a detailed view of adjustment assembly 150 with one bracket plate 161 removed for clarity. Lever arms 155 extend from adjacent pole 115 to adjustment portion 140. Lever arms 155 include a distal end 156 pivotally mounted to the adjustment portion 140 of linkage structure 130, and include a proximal end 157 mounted on or closely adjacent pole 115. In one embodiment, proximal end 157 is pivotally mounted to bracket assembly 160, for example to connection point and pivot axis 167 in side plates 164. Proximal end 157 is preferably mounted at a fixed height relative to pole 115.

A bracket assembly 160 extends outward from pole 115 to support actuator 170. In an example preferred embodiment, bracket assembly 160 includes a bracket sleeve 166 secured to pole 115, and creating a sleeve or slide-through space between bracket 166 and pole 115. A pair of bracket plates 161, with one shown in detail in FIG. 10, each include an ear portion 162 and a side plate 164, and can be mounted to pole 115 by sliding the ear portions 162 behind bracket sleeve 166. Bracket plates 161 can optionally be secured in place to the pole and in relation to each other by one or more bolts, rivets, screws, welding or similar fasteners extending all or partly through one or both plates or to mounting tabs 168 of bracket sleeve 166.

In one option, bracket plates 160 include side plates 164 extending closely adjacent and on opposing sides of parallel lever arms 155 and which conceal or cover the midpoint connection 177 between the actuator 170 and the lever arms 155. Preferably once assembled the midpoint is covered through the range of motion of the lever arms. The close arrangement of the side plates retains the actuator within the lever arms and assists in preventing the lever arms from spreading and unintentionally disengaging from the bracket assembly. The close arrangement further minimizes the risk of a user being pinched due to movement of the lever arms. In certain options, the actuator includes portions, such as bolts or bars with nuts or cotter pins, extending through both side plates to secure the actuator in place and provides a pivot axle 163 at lower connection point 173 and which simultaneously secure the side plates from disengaging.

Actuator 170 is mounted between a connection point or axis 163 in a fixed height correspondence to pole 115, for example in bracket assembly 160, and a midpoint 156 of lever arm 155. One example of an actuator 170 is an extension cylinder. Extension or retraction of actuator 170 causes a rotation of lever arm 155 around proximal end 157 to raise and lower distal end 156 and correspondingly adjustment portions 140. As illustrated, actuator 170 includes a first portion 172 with connection points 173 secured to corresponding fixed points, for example in side plates 164. Actuator 170 further includes a second portion 176 connected using a connection point 177 at a midpoint 158 along lever arm 155. Preferably second portion 176 can be raised and lowered in relation to first portion 172, for example by telescoping.

In a preferred embodiment, first portion 172 includes an outer cylinder shell 174 and an inner worm gear or screw. Second portion 176 includes an inner cylinder shell 178 preferably sized to be received and telescope within outer shell 174, and further includes an internal bearing point such as a threaded bearing nut or plate. Bearing point 179 is preferably threadably engaged with worm gear 75. A rotatable handle, such as crank 180, controls actuator 170, for example via a set of bevel gears which engage the worm gear. It will be understood that the worm gear and bearing point and/or the telescoping direction and/or the inner/outer relationship of cylinder portions can be reversed without functionally effecting the present invention.

In an optional preferred feature, weather seal 184 covers the transition from lower, outer shell 174 to upper, inner shell 178. Weather seal 184 allows telescoping and relative movement of the cylinder pieces, yet inhibits moisture or debris from entering between the cylinder pieces. In a preferred embodiment, weather seal 184 is formed as a collar with an outer portion which snugly engages outer shell 174 and an inward flange which snugly engages inner shell 178. Additionally, a cap 188 may be used to seal the upper end of inner shell 178. A soft rubber is one preferred material for seal 184 and cap 188.

Two lever arms 155, two adjustment portions 140 and two connection points 173 and 177 are shown in parallel as a preferred embodiment, it will be understood that only one of each is required. The width of the one or more lever arms can be varied as desired while considering functional factors such as weight and strength.

As an example, but not by way of limitation, the actuator assembly may include dimensions where the outer portion has a length of 9 inches with an inner diameter of 2.0625 inches, and a distance of 6 inches from the bottom of the bevel gear box to the outer portion connection point. Inner portion has a length of 6 inches and an outer diameter of 2.0 inches and is nested within the outer portion. The worm gear is mounted within the outer portion, and has a length slightly less than 9 inches, a width of ¾ of an inch and a pitch of 8 threads per inch. The bearing point in the inner portion is threadably configured to receive a ¾ inch screw with an 8 threads per inch pitch. The telescoping travel of the actuator assembly in this example is approximately 4.17".

By way of example, the lever arm may have an effective length of 9.25 inches between the centers of the connection points at the proximal end and the distal end. A suitable midpoint is located between the proximal end and the distal end, for example 3.125 inches measured outward from the center of the pivot axis at the proximal end.

In a preferred embodiment, the force transmitted through actuator assembly is a sufficient counter-force to balance and statically hold the weight of the backboard assembly which is above and to the opposite side of the support pole. The actuator has a shorter applied lever arm, so it requires applying a greater counter-force to reach equilibrium between the actuator and the backboard assembly than if the actuator were directly attached to the lever arm distal end or directly incorporated into the adjustment arm.

If not neutrally balanced, the generally greater mass of the backboard applies a downward force to the support structure, typically transmitting an upward tension to the adjustment arm and lever arm. In the example of basketball goal 10, lever arm 55 typically applies a compression force between the upper and lower portions of the actuator assembly 70. In the example of basketball goal 100, lever arm 155 typically applies an expansion force between the upper and lower portions of the actuator 170.

Figure 10:
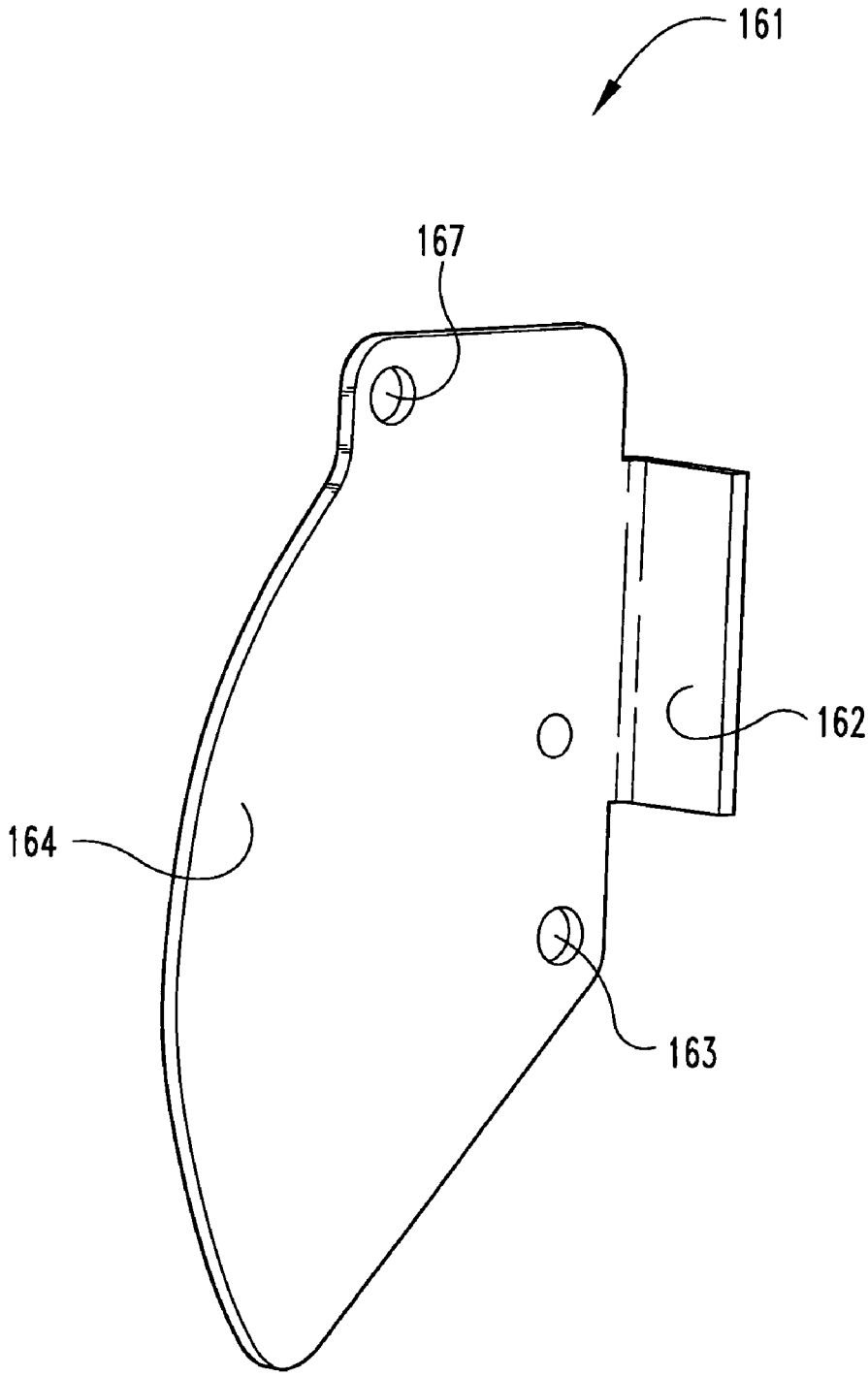
FIG. 10 is a perspective view of a bracket plate used in certain preferred embodiments of the present invention.
Figure 11:
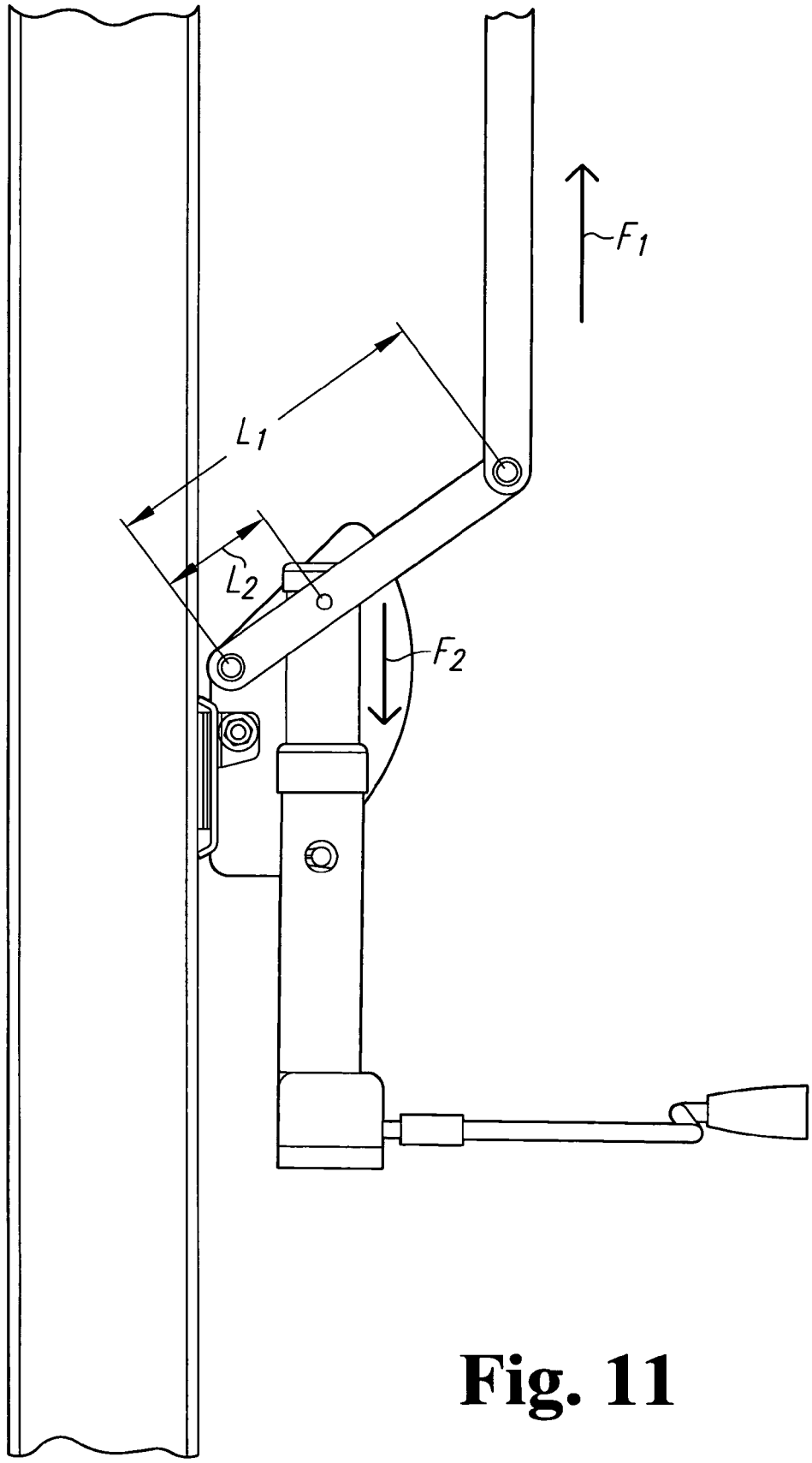
FIG. 11 is a force diagram of the embodiment of FIG. 6.

Stated another way and illustrated with a force diagram in FIG. 11, the torque applied to the entire lever arm by the adjustment arms is balanced by equal torque of a greater compression force applied over a shorter lever arm between the proximal end 157 of the lever arm and midpoint 156. Torque is calculated using the known relationship: torque equals the applied force multiplied by the applied lever arm length ($\tau=F\times L$). As illustrated in FIG. 10, the force $F_1$ of the backboard assembly is applied over the length $L_1$ of lever arm 155. This is balanced ($F_1L_1=F_2L_2$) by the force $F_2$ of the actuator applied over a shorter lever arm $L_2$ with a length defined between the proximal end 157 and the midpoint 156.

As a feature of the present invention, due to the lever arm disparity, the vertical distance of travel in extending or retracting the actuator is magnified by rotation of the lever arm around its proximal end to cause a correspondingly greater adjustment in the vertical distance of travel of the distal end of the lever arm, thus driving the adjustment arms. As one advantage, this allows a reduced number of rotations of the handle or crank to raise and lower the backboard assembly a specific distance than would a prior art design where the adjustment arm is directly connected to the extension tube. For example, an actuator directly connected to the proximal end may have required approximately 80-100 crank turns to adjust the backboard height from approximately 7½ feet to approximately 10 feet, while in contrast the present invention allows approximately 20-40 crank turns for the same height adjustment. The distance of midpoint 156 to proximal end 157 can be varied as will be understood by those of skill in the art, and will cause a corresponding change in the actuator's mechanical advantage and compression force.

As an additional optional feature, the actuator assembly 170 is pivotally connected to the bracket assembly 160 at mounting points 173 such that the entire actuator assembly will slightly rotate to maintain a direct bearing axis along the actuator and to compensate for the fixed radius of lever arm length $L_2$ as the lever arm rotates and the backboard assembly is raised and lowered.

Basketball goal systems of the present invention are manufactured of conventional materials such as a metal pole, a glass and/or acrylic backboard and metal framing and arms. Typical metals include aluminum, steel and stainless steel. The metals may be coated or painted for protection from the environment and to resist wear and tear. Cushions may be added as desired to minimize any collision impact with the goal. Additionally, pivot locations are created using various connection methods such as pivot bolts, screws and solid or hollow bars and are spaced and secured using conventional fasteners such as metal or nylon washers, threaded nuts, cotter pins, rivets, cold forging or welding as appropriate.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A basketball goal, comprising:

a. a vertical support element;

b. a backboard assembly;

c. an adjustment structure adjustably mounting said backboard assembly to said support element;

d. said adjustment structure having a rear extension portion movable to control the height of said backboard assembly;

e. at least one adjustment arm extending downward from said rear extension portion;

f. at least one lever arm having a proximal end pivotally mounted adjacent said support element and having a distal end pivotally mounted to said adjustment arm; and, g. an actuator mounted to said lever arm at a midpoint between said proximal end and said distal end, wherein operation of said actuator causes said lever arm to rotate and correspondingly adjust the height of said backboard assembly h. a bracket assembly wherein said bracket assembly comprises a pair of side plates on opposing sides of said lever arm and wherein said midpoint where said actuator is mounted to said lever arm is concealed between said side plates.

2. The basketball goal of claim 1, wherein operation of said actuator on said lever arm causes a raising or lowering of said proximal end a movement distance greater than the movement distance of said midpoint.

3. The basketball goal of claim 2, wherein said adjustment structure comprises a parallelogram assembly between said backboard and said support element.

4. The basketball goal of claim 3, wherein said actuator is mounted to a bracket assembly secured to said support element.

5. The basketball goal of claim 4, wherein said actuator is pivotally mounted to said bracket assembly.

6. The basketball goal of claim 5, wherein said actuator is pivotally mounted to said lever arm.

7. The basketball goal of claim 3, wherein said actuator is an extension cylinder.

8. The basketball goal of claim 7, wherein said actuator comprises an upper portion and a lower portion and wherein said actuator is operable to adjust the relative extension of said upper portion to said lower portion.

9. The basketball goal of claim 8, comprising a worm gear connecting said upper portion to said lower portion.

10. The basketball goal of claim 4, wherein said proximal end of said lever arm is pivotally mounted to said side plates.

11. The basketball goal of claim 1, wherein said side plates are removably mourned to said support element.

12. The basketball goal of claim 11, wherein said actuator is mounted to said side plates in a manner to prevent removal of said side plates from said support element.

13. The basketball goal of claim 11, wherein said side plates each comprise an ear portion receivable in a support sleeve on said support element to removably mount said side plates to said support element.

14. The basketball goal of claim 1, comprising a pair of parallel adjustment arms extending downward from said adjustment structure and a pair of parallel lever arms, each lever arm having a proximal end pivotally mounted adjacent said support element and having a distal end pivotally mounted to one of said adjustment arms, and wherein said actuator is mounted to said lever arms at parallel midpoints between said proximal ends and said distal ends.

15. A basketball goal, comprising:

a. a vertical support element;

b. a backboard assembly adjustably mounted to said vertical support element;

c. at least one lever arm having a proximal end secured adjacent said support element and having a distal end linked to said backboard assembly; and, d. an actuator mounted to said lever arm at a midpoint between said proximal end and said distal end, wherein operation of said actuator causes the distal end of said lever arm to raise or lower and to correspondingly adjust the height of said linked backboard assembly e. a bracket assembly wherein said bracket assembly comprises a pair of side plates on opposing sides of said lever arm and wherein said midpoint where said actuator is mounted to said lever arm is concealed between said side plates.

16. The basketball goal of claim 15, wherein said actuator comprises a proximal portion secured at a fixed height relative to said support element and a distal portion mounted to said midpoint.

17. The basketball goal of claim 16, wherein said proximal portion of said actuator is secured to a bracket assembly extending from said support element.

18. The basketball goal of claim 17, wherein said proximal portion of said actuator is pivotally mounted to said bracket assembly.

19. The basketball goal of claim 16, wherein operation of said actuator on said lever arm causes said proximal end to raise or lower a distance which is greater than the distance said midpoint is caused to raise or lower.

20. The basketball goal of claim 19, wherein said actuator comprises a rotatable handle for operating said actuator.

21. The basketball goal of claim 20, wherein said actuator comprises a worm gear and bearing plate mounted between said proximal portion and said distal portion, wherein said worm gear is driven by said rotatable handle.

22. The basketball goal of claim 19, wherein said actuator comprises an extension cylinder.

23. The basketball goal of claim 15, comprising a pair of parallel lever arms, each having a proximal end mounted adjacent said support element and having a distal end linked to said backboard assembly, and wherein said actuator is mounted to said lever arms at parallel midpoints between said proximal ends and said distal ends.

24. The basketball goal of claim 23, wherein side plates on a bracket assembly mounted on said support element cover said parallel midpoints through the range of motion of said lever arm.

25. The basketball goal of claim 24, wherein said proximal ends of said lever arms are pivotally mounted to said side plates.

26. A basketball goal, comprising:

a. a vertical support element;

b. a backboard assembly adjustably mounted to said vertical support element;

c. at least one adjustment arm connected with and extending downward from said backboard assembly;

d. a lever arm controlling adjustment of said backboard assembly and defining a first lever arm length, wherein said first lever arm length is defined between a proximal end of said lever arm connected to said vertical support element and a distal end of said lever arm connected to said adjustment arm; and, e. an actuator operably connected to said lever arm and controlling said lever arm over a second lever arm length, wherein said second lever arm length is less than said first lever arm length f. a bracket assembly wherein said bracket assembly comprises a pair of side plates on opposing sides of said lever arm and wherein said midpoint where said actuator is mounted to said lever arm is concealed between said side plates.

27. The basketball goal of claim 26, wherein said lever arm is rotatably mounted to said support element.

28. The basketball goal of claim 27, wherein said actuator has a portion secured at a fixed height relative to said support element.

29. The basketball goal of claim 28, wherein said actuator is an extension cylinder.

* * * * *